US011953288B2

(12) United States Patent
Bergman

(10) Patent No.: US 11,953,288 B2
(45) Date of Patent: Apr. 9, 2024

(54) SLING SLIDER

(71) Applicant: Tech-10 Tactical, Stafford, VA (US)

(72) Inventor: Paul Bergman, Stafford, VA (US)

(73) Assignee: TECH-10 TACTICAL, Stafford, VA (US)

( * ) Notice: Subject to any disclaimer, the term of this patent is extended or adjusted under 35 U.S.C. 154(b) by 0 days.

(21) Appl. No.: 17/857,832

(22) Filed: Jul. 5, 2022

(65) Prior Publication Data

US 2022/0333895 A1 Oct. 20, 2022

Related U.S. Application Data

(63) Continuation of application No. 17/326,423, filed on May 21, 2021, now Pat. No. 11,415,385, which is a continuation of application No. 16/832,670, filed on Mar. 27, 2020, now Pat. No. 11,041,691, which is a continuation-in-part of application No. 16/684,959, filed on Nov. 15, 2019, now abandoned.

(60) Provisional application No. 62/769,639, filed on Nov. 20, 2018.

(51) Int. Cl.

| | |
|---|---|
| ***F41C 23/02*** | (2006.01) |
| ***A44B 11/04*** | (2006.01) |
| ***F41C 3/00*** | (2006.01) |
| ***F41C 33/00*** | (2006.01) |

(52) U.S. Cl.

CPC ..... *F41C 23/02* (2013.01); *A44B 11/04* (2013.01); *F41C 33/002* (2013.01); *Y10T 24/4093* (2015.01)

(58) Field of Classification Search

CPC ..... F41C 23/02; F41C 33/002; A44B 11/04; Y10T 24/4093

See application file for complete search history.

(56) References Cited

U.S. PATENT DOCUMENTS

| | | | | | |
|---|---|---|---|---|---|
| 411,777 | A | * | 10/1889 | Behrens | A44B 11/04 24/169 |
| D685,445 | S | * | 7/2013 | Pittman | D22/108 |
| 8,733,601 | B2 | | 5/2014 | Burnsed, Jr. | |
| D717,391 | S | * | 11/2014 | Pittman | D22/108 |
| 9,157,700 | B1 | * | 10/2015 | Hansen | F41C 23/02 |
| 9,528,795 | B1 | * | 12/2016 | Burnsed, Jr. | F41C 33/002 |
| 10,731,945 | B2 | * | 8/2020 | Tower | F41C 23/02 |

(Continued)

*Primary Examiner* — Robert Sandy
*Assistant Examiner* — Louis A Mercado
(74) *Attorney, Agent, or Firm* — Bennet K. Langlotz; Langlotz Patent & Trademark Works, LLC

(57) ABSTRACT

Sling sliders have a body defining an elongated sling strap passage configured to receive an elongated sling strap, the elongated sling strap passage defined at least in part by an elongated bar having opposed ends, the elongated bar defining an elongated cord passage extending between the opposed ends of the elongated bar, a cord received in the elongated cord passage, and the cord having a received portion within the elongated cord passage and a handle portion extending outside the elongated cord passage such that the handle portion operates to exert a motive force on the body. The sling slider may be a triglide. The body may have three parallel bars, and the elongated bar defining the elongated cord passage may be positioned between a second bar and a third bar. The body may define a pair of elongated sling strap passages on opposite sides of the elongated bar.

1 Claim, 3 Drawing Sheets

(56) References Cited

U.S. PATENT DOCUMENTS

| | | | | |
|---|---|---|---|---|
| 2014/0203053 | A1* | 7/2014 | Rivas-Schlanger | F41C 23/02<br>224/150 |
| 2017/0314888 | A1* | 11/2017 | Beck | F41C 33/002 |
| 2020/0154833 | A1* | 5/2020 | Bergman | A44B 11/04 |

* cited by examiner

SLING SLIDER

CROSS-REFERENCE TO RELATED APPLICATION

This application is a Continuation-in-Part of U.S. patent application Ser. No. 16/684,959 filed on Nov. 15, 2019, entitled "T-10 TRIGLIDE," now issued as U.S. Pat. No. 11,415,385 which claims the benefit of U.S. Provisional Patent Application No. 62/769,639 filed on Nov. 20, 2018, entitled "T-10 TRIGLIDE," which are hereby incorporated by reference in their entirety for all that is taught and disclosed therein.

FIELD OF THE INVENTION

The present invention relates to slings, and more particularly to a sling slider that is used to attach slings to a weapon.

BACKGROUND OF THE INVENTION

Most existing weapon slings use triglides in some capacity, including attaching quick disconnectors to the sling, attaching the sling to a weapon, and adjusting the length of the sling. Prior art triglides come in various shapes, colors, and materials. Most existing weapon slings are adjusted for length by sliding a triglide back and forth across the webbing by the user either placing a hand on the triglide, or by using a pull tab connected to the triglide to move the triglide forward and backward across the webbing.

One example of a triglide with a pull tab is disclosed in U.S. Pat. No. 8,733,601 to Burnsed, Jr. This weapon sling uses a triglide with a custom post that is built onto the triglide. A pull tab is attached to the post so the triglide can be pulled forward and backward via the pull tab to adjust the length of the weapon sling. U.S. Pat. No. 8,733,601 to Burnsed, Jr. also teaches the use of conventional triglides lacking a custom post for attaching a pull tab. A disadvantage of the triglide with a custom post is that the custom post protrudes above the main portion of the triglide, which could make the triglide with a custom post vulnerable to snagging on objects in the user's environment.

Therefore, a need exists for a new and improved sling slider that enables rapid adjustment of the length of the user's weapon sling while maintaining a very low-profile comparable to that of a conventional triglide. In this regard, the various embodiments of the present invention substantially fulfill at least some of these needs. In this respect, the sling slider according to the present invention substantially departs from the conventional concepts and designs of the prior art, and in doing so provides an apparatus primarily developed for the purpose of enabling rapid adjustment of the length of a user's weapon sling while maintaining a very low-profile comparable to that of a conventional triglide.

SUMMARY OF THE INVENTION

The present invention provides an improved sling slider, and overcomes the above-mentioned disadvantages and drawbacks of the prior art. As such, the general purpose of the present invention, which will be described subsequently in greater detail, is to provide an improved sling slider that has all the advantages of the prior art mentioned above.

To attain this, the preferred embodiment of the present invention essentially comprises a body defining an elongated sling strap passage configured to receive an elongated sling strap, the elongated sling strap passage defined at least in part by an elongated bar, the elongated bar having opposed ends, the elongated bar defining an elongated cord passage extending between the opposed ends of the elongated bar, a cord received in the elongated cord passage, and the cord having a received portion within the elongated cord passage and a handle portion extending outside the elongated cord passage such that the handle portion operates to exert a motive force on the body. The sling slider may be a triglide. The body may have three parallel bars, and the elongated bar defining the elongated cord passage may be positioned between a second bar and a third bar. The body may define a pair of elongated sling strap passages on opposite sides of the elongated bar. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
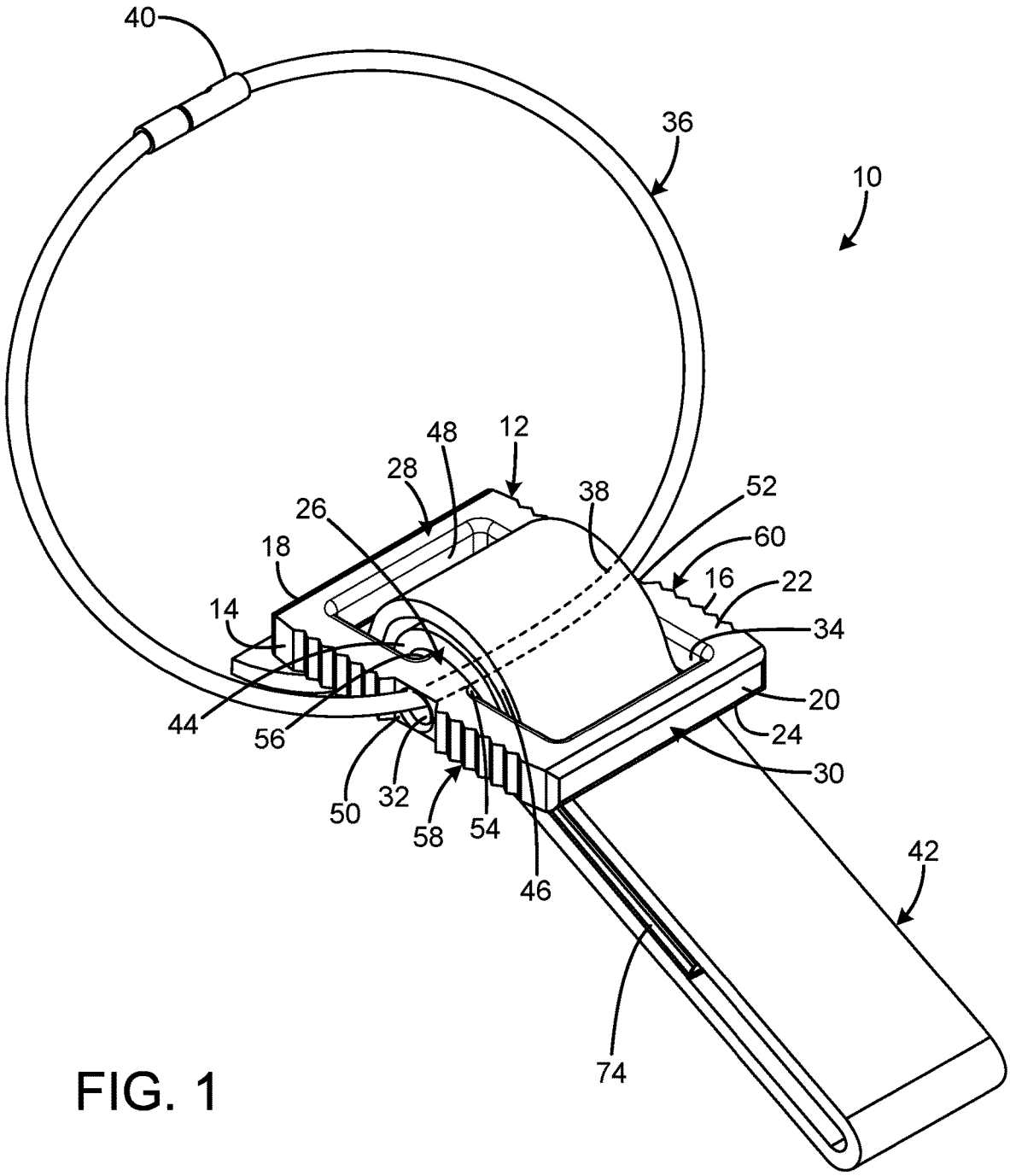
FIG. 1 is a top isometric view of the current embodiment of a sling slider constructed in accordance with the principles of the present invention with a cord and elongated sling strap attached.

An embodiment of the sling slider of the present invention is shown and generally designated by the reference numeral 10.

Figure 2:
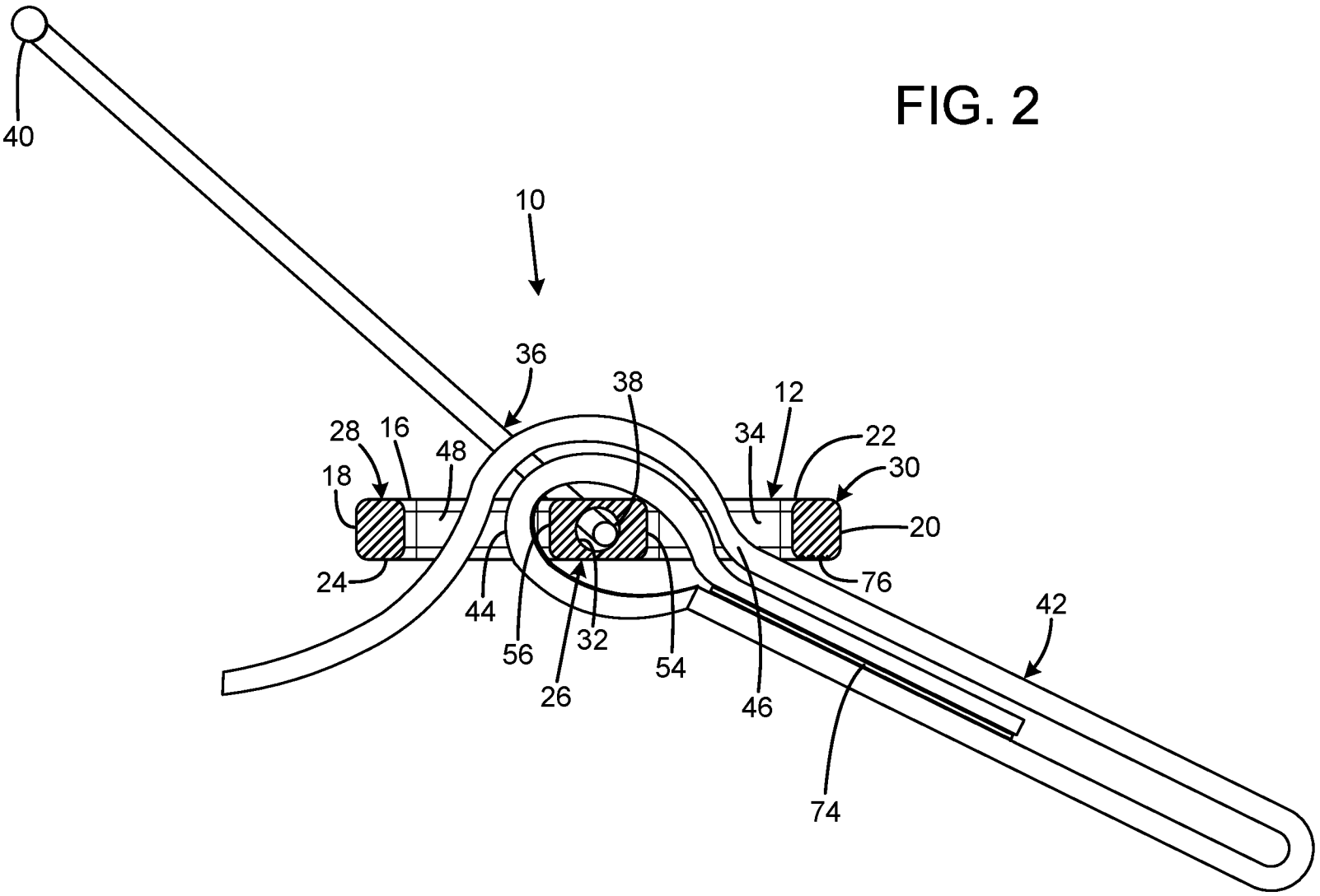
FIG. 2 is a side sectional of the sling slider of FIG. 1 with the cord and elongated sling strap attached.
Figure 3:
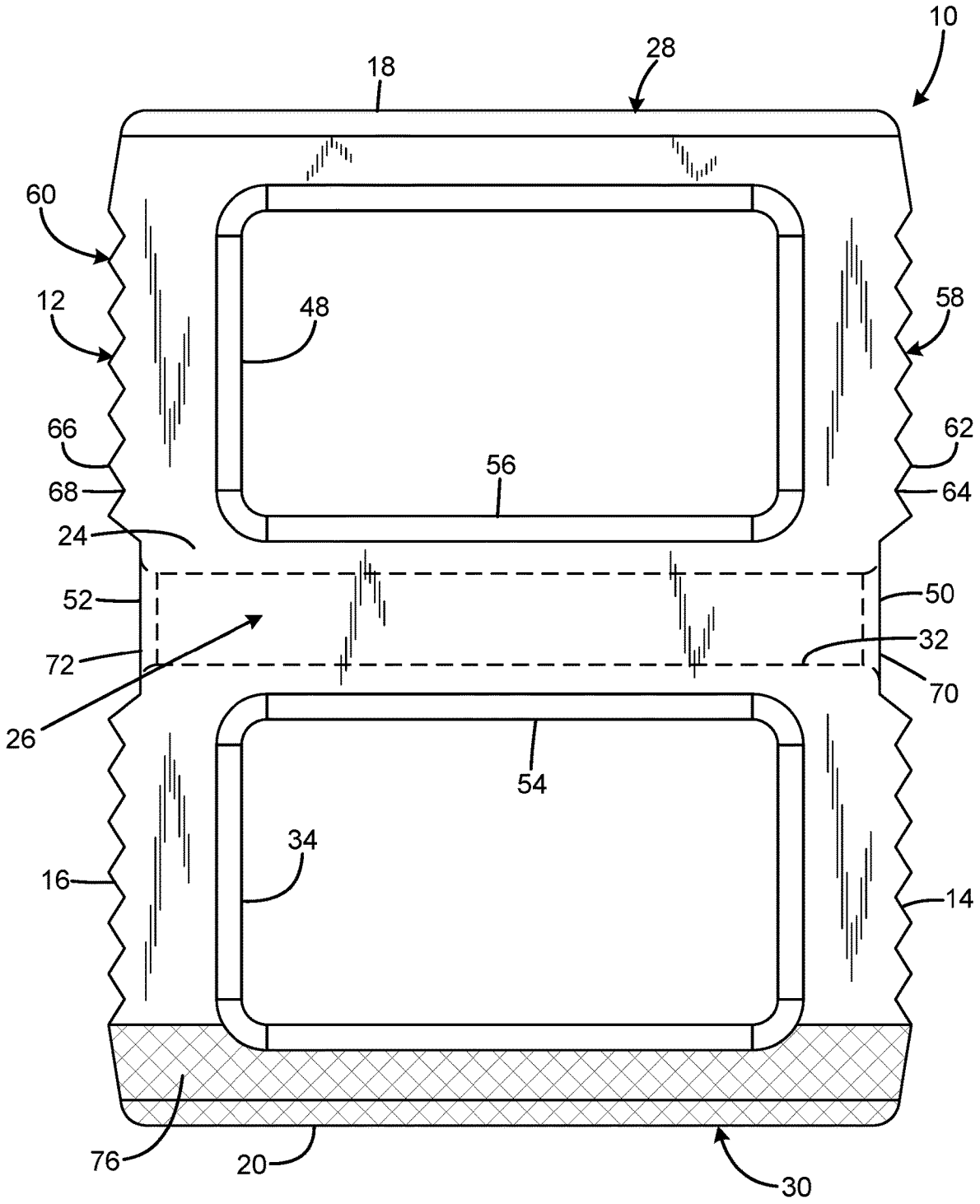
FIG. 3 is a top view of the sling slider of FIG. 1 with the cord and elongated sling strap removed.

FIGS. 1-3 illustrate the improved sling slider 10 of the present invention. More particularly, the sling slider has a body 12 having opposed sides 14, 16, opposed ends 18, 20, a top 22, and a bottom 24. The body has three parallel bars connecting the opposed sides to each other (elongated bar 26, second bar 28, and third bar 30). The second and third bars form the opposed ends of the body, and the elongated bar is positioned between the second and third bars. The elongated bar has opposed ends 50, 52 and defines an elongated cord passage 32 extending between the opposed ends of the elongated bar. A cord 36 is received in the elongated cord passage. The cord has a received portion 38 within the elongated cord passage and a handle portion 40 extending outside the elongated cord passage such that the handle portion operates to exert a motive force on the body when pulled. In the current embodiment, the cord is a loop made of stainless steel aircraft cable with a length of 5, 6, or 7 inch with a locking clasp to form the handle portion. In use, an operator inserts his or her thumb through the loop to pull the sling slider. An optional pull tab made of webbing (not shown) can be added to the cord to serve as an additional handle portion. Different pull tabs can be substituted to change the length or color of the pull tab. The cord is designed to break at 180 psi in case the loop becomes caught on an object during use. The longer 7 inch cord facilitates operation of the sling slider by an operator wearing thick gloves for cold weather conditions by making the loop larger so the operator can insert his or her thumb through the loop to pull the sling slider. The elongated cord passage is a 0.18 inch bore completely drilled through the elongated bar that is countersunk on both ends to facilitate insertion of one end of the cord into the elongated cord passage.

The opposed sides 14, 16 of the body 12 define serrations 58, 60 to facilitate gripping of the body in the event the operator prefers to pull the sling slider without the cord 36 being attached to the body. Serrations 58 have peaks 62, valleys 64, and a wide valley 70 corresponding to the opposed end 50 of the elongated bar. Serrations 60 have peaks 66, valleys 68, and a wide valley 72 corresponding to the opposed end 52 of the elongated bar.

The body 12 defines a pair of elongated sling strap passages 34, 48 on opposite sides 54, 56 of the elongated bar 26. Each elongated sling strap passage is configured to receive an elongated sling strap 42. The elongated sling strap includes a slide stop 74 that is integral to the elongated sling strap and limits forward movement of the body to prevent the elongated sling strap from wrapping around the quick disconnect attachment point on the rail of an associated firearm. In the current embodiment, the slide stop is a 1 inch wide by 3 inch long piece of plastic that is sewn between two layers of the elongated sling strap that are folded to overlap. An end portion 44 of the elongated sling strap is secured to the elongated bar 26, and an intermediate portion 46 of the elongated sling strap passes through the elongated sling strap passages 34, 48. The opposed sides 14, 16, top 22, and bottom 24 of the elongated sling strap passages are rounded to facilitate sliding of the intermediate portion of the elongated sling strap within the elongated sling strap passages. Thus, when the user pulls on the handle portion 40 of the cord 36, the body slides easily forward or backward along the intermediate portion of the elongated sling strap to quickly adjust the length of the weapon sling formed by the elongated sling strap. In the current embodiment, the elongated sling strap passages can be 1 inch, 1.25 inch, or 1.5 inch wide to accommodate the most common widths of webbing used for weapon slings. However, the width of the elongated sling strap passages can be any desired distance to accommodate any width of webbing. It should also be appreciated that the term "sling slider" should not be viewed as limiting, and the body can also be referred to as a buckle or a triglide. The bottom 24 of the end 20 of the body has a knurled area 76 to create more friction when interfacing with the elongated sling strap to prevent the elongated sling strap from unintentionally slipping through the elongated sling strap passage 34.

In the current embodiment, the sling slider has the following dimensions: a thickness of 0.25 inch, an overall maximum width of 1.58 inch, and a minimum overall width on opposed ends 50, 52 of the elongated bar 26 of 1.45 inch. The elongated bar has a width of 0.40 inch and a length of 1.05 inch. The pair of elongated sling strap passages 34, 48 on opposite sides 54, 56 of the elongated bar each have a width of 0.60 inch and a length of 1.05 inch to accommodate 1 inch wide webbing. The serrations 58, 60 have a distance between adjacent peaks 62, 66 of 0.10 inch and a distance between adjacent peaks and valleys 64, 66 of 0.05 inch. The sling slider is machined from 4140 carbon steel and has an MIL-DTL-13924 black oxide coating applied to prevent corrosion. The elongated sling strap is preferably made of poly-paraphenylene terephthalamide to prevent the elongated sling strap from melting if the elongated sling strap is accidentally left in contact with a hot firearm barrel or suppressor.

While a current embodiment of a sling slider has been described in detail, it should be apparent that modifications and variations thereto are possible, all of which fall within the true spirit and scope of the invention. For example, in addition to the weapon slings described, the sling slider is also suitable for use with any object including webbing or a strap, including shoulder bags, purses, duffel bags, backpacks, waist packs, camera straps, and binocular straps. Furthermore, the stainless steel aircraft cable could be replaced with 550 paracord, a shoelace, or any other suitable cord material, and a knot in the ends of the 550 paracord, shoelace, or any other suitable cord material could be substituted for the locking clasp. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A sling slider comprising:

a body defining an elongated sling strap passage configured to receive an elongated sling strap;

the elongated sling strap passage defined at least in part by an elongated bar;

the elongated bar having opposed ends;

the elongated bar defining an elongated cord passage extending between the opposed ends of the elongated bar;

a cord received in the elongated cord passage;

the cord having a received portion within the elongated cord passage and a handle portion extending outside the elongated cord passage such that the handle portion operates to exert a motive force on the body; and the elongated cord passage being parallel to the elongated sling strap passage.

* * * * *